US007347618B2

(12) United States Patent
Mojon et al.

(10) Patent No.: US 7,347,618 B2
(45) Date of Patent: Mar. 25, 2008

(54) AUTOMATIC PAWL WINDING MECHANISM

(75) Inventors: Jean-François Mojon, Les Hauts-Geneveys (CH); Norberto Perucchi, Saint-Blaise (CH)

(73) Assignee: Richemont International S.A., Villars-sur-Glane (CH)

( * ) Notice: Subject to any disclaimer, the term of this patent is extended or adjusted under 35 U.S.C. 154(b) by 82 days.

(21) Appl. No.: 11/320,954

(22) Filed: Dec. 30, 2005

(65) Prior Publication Data

US 2006/0239126 A1 Oct. 26, 2006

(30) Foreign Application Priority Data

Jan. 21, 2005 (CH) ..... 0096/05

(51) Int. Cl.
*G04B 5/18* (2006.01)

(52) U.S. Cl. ..... 368/208; 368/125

(58) Field of Classification Search ..... None
See application file for complete search history.

(56) References Cited

U.S. PATENT DOCUMENTS 2,867,971 A * 1/1959 Bertsch et al. ..... 368/208

3,901,021 A * 8/1975 Tutiya ..... 368/208

FOREIGN PATENT DOCUMENTS

EP 1 041 458 10/2000

* cited by examiner

*Primary Examiner*—Renee Luebke
(74) *Attorney, Agent, or Firm*—Young & Thompson

(57) ABSTRACT

An automatic pawl winding mechanism for a watch movement has a rotor solidly attached to a rotor wheel and oscillating about the axis of a rotor pivot, a pawl wheel to which an oscillating motion of rotor is transmitted by the rotor wheel being pivoted about the axis of a pawl wheel shaft, at least one pawl being eccentrically attached to the pawl wheel shaft, and an automatic wheel cooperating with the pawl or pawls. The oscillating motion of the rotor wheel is thus transformed into a unidirectional rotary motion of the automatic wheel, and this rotary motion is transmitted to a ratchet wheel via a transformation gear train. The rotor, the gear train from the rotor with rotor wheel to the pawl wheel with the pawl or pawls is mounted on an independent rotor bridge while no other organ of the mechanism is mounted on this bridge.

14 Claims, 5 Drawing Sheets

AUTOMATIC PAWL WINDING MECHANISM

The object of the present invention is an automatic pawl winding mechanism for a movement that comprises an oscillating weight or rotor solidly attached to a rotor wheel and oscillating about the axis of a rotor pivot, a pawl wheel articulated rotatably about the axis of a pawl wheel shaft to which an oscillating motion of the rotor is transmitted, at least one pawl mounted eccentrically about the axis of this pawl wheel shaft, and an automatic wheel cooperating with the pawl or pawls in such a manner that the oscillating motion of the rotor wheel is transformed to a unidirectional rotary motion of the automatic wheel, and transmitting this rotary motion via a gear train to a pawl wheel.

Devices of this type have basically been known for a long time in different embodiments. In the document EP 1 041 458, for instance, an automatic pawl winding device of this kind is presented in which the different elements of the device are more particularly arranged between several supporting structures which in part also serve to attach other parts of the movement to them. Such a conventional construction is relatively complicated and entails difficulties in assembly, possibly as well a specific setting between the different parts, and it may also complicate maintenance of the watch, since access to one part of the watch may require disassembly of another part.

The invention further relates to a support acting as a shock absorber for the rotor or generally for the parts attached to this support, this support being useful in general for the most diverse applications within watches.

In watches, it is in fact desirable in particular applications that such a support has elastic properties in a plane, such that the spring constant of the support has the same value independently of the direction of motion of the support in this plane. The term "same value" is used in the text below for a spring constant in the sense that a maximum departure of about ±20% from the average value of the spring constant is accepted. Furthermore, the support should have the largest possible rigidity in a direction normal to this plane in order to limit motions of the support along this axis.

It is the aim of the present invention to obviate the disadvantages mentioned above and to realise the features cited above, by proposing a particular automatic pawl winding mechanism.

Notably, the rotor as well as the gear train of the proposed automatic pawl winding mechanism from the rotor with the rotor wheel to the pawl wheel with the pawl or pawls are mounted on an independent rotor bridge, these parts thus constituting an independent module in the sense that no other element of the mechanism is attached to this independent rotor bridge.

On the other hand, an independent rotor support or independent rotor bridge is proposed in the present invention which can be designed such as to constitute a support that will act as a shock absorber for the rotor or all parts that are mounted on this bridge that latter having the properties mentioned above due to the fact of having a special geometric shape. This support is useful generally and independently for applications of the most diverse kind in watches where a support is needed that simultaneously constitutes a shock absorber, for instance for attenuation of the pivoting of a mobile.

Further advantages will become evident from the features expressed in the dependent claims as well as from the description which hereinafter will explain the invention in greater detail with the aid of drawings.

The attached drawings represent by way of example an embodiment of the invention.

Figure 3:
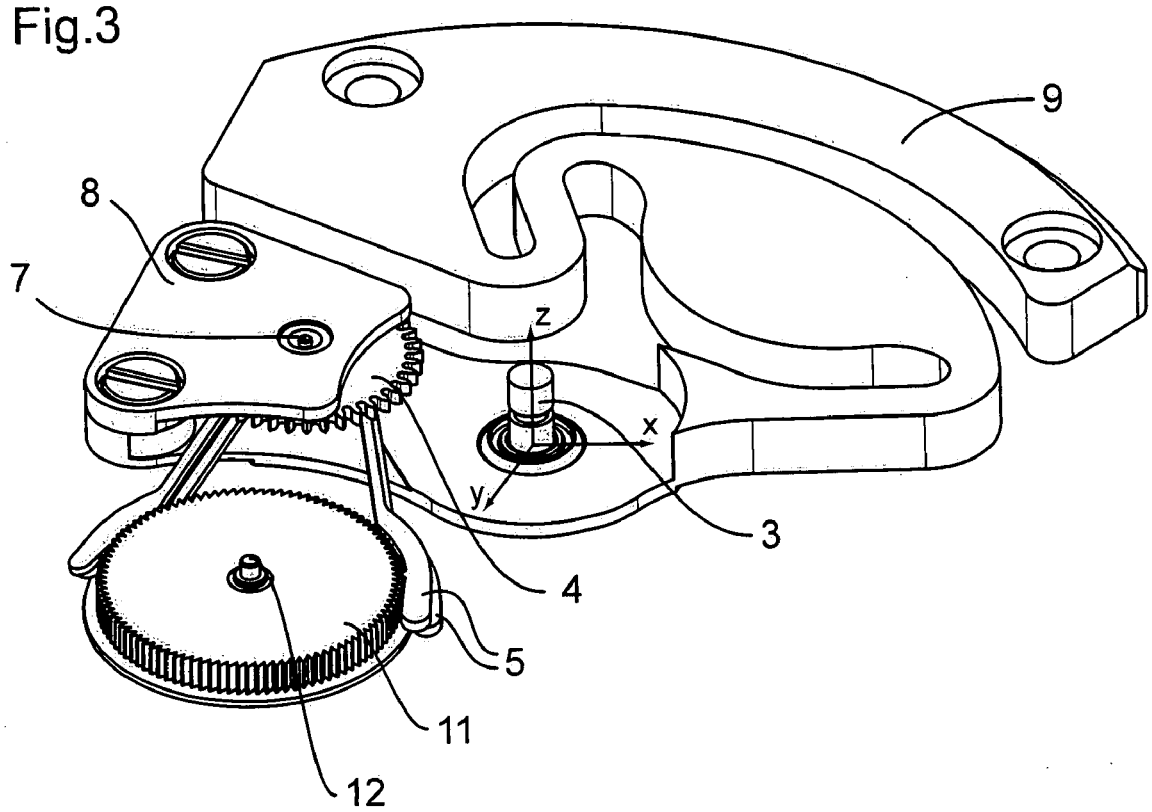
FIG. 3 is a perspective view of a particular embodiment of an independent rotor bridge without rotor, but with the pawl wheel and with the automatic wheel.
Figure 5A:
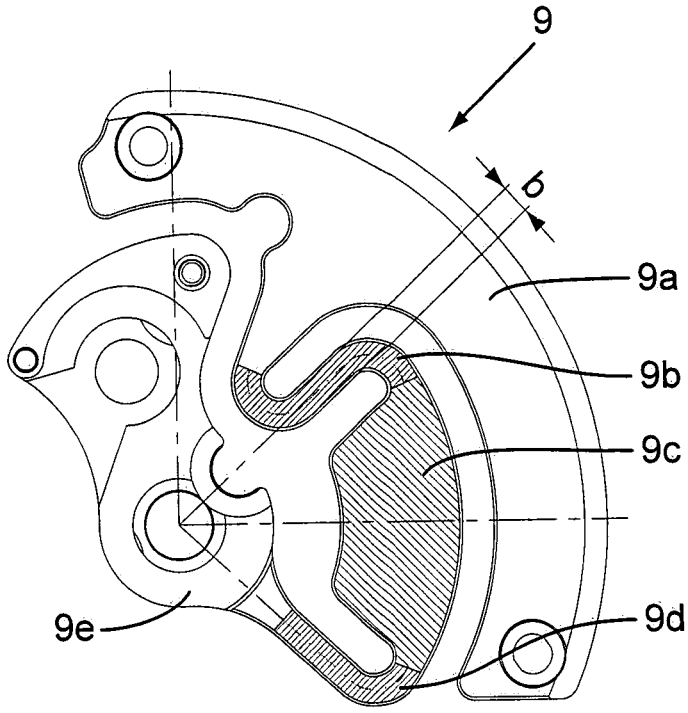

FIG. 5*a* is a schematic plan view of the embodiment of an independent rotor bridge according to FIG. 3 where the different segments of the bridge are distinguished by different hatching.

Figure 5B:
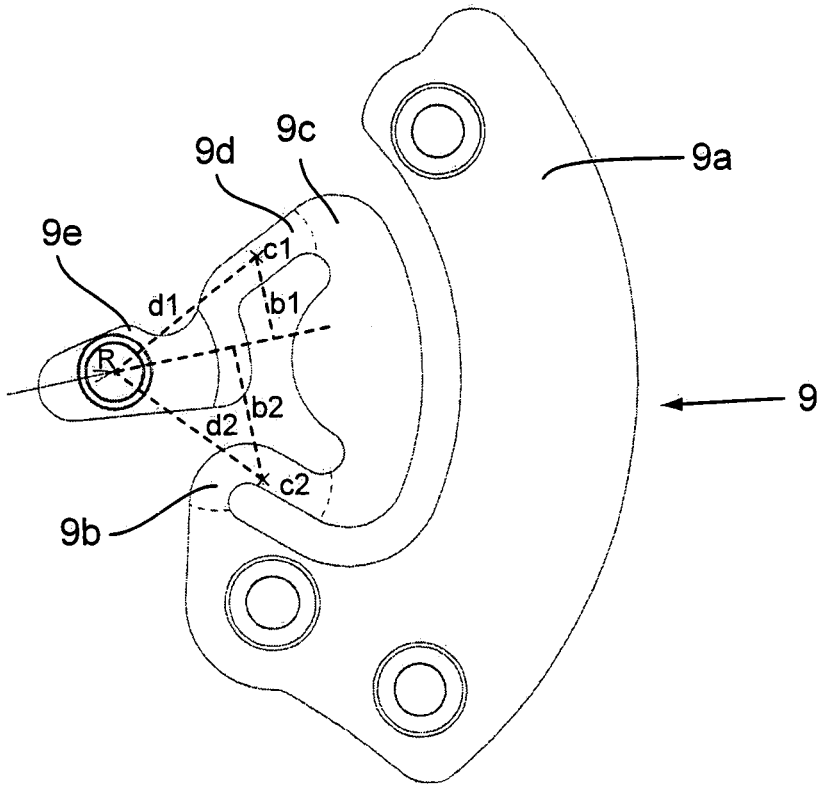

FIG. 5*b* is a schematic view of a further embodiment of an independent rotor bridge according to the present invention in which the different geometric values and their relationships which are used to define the geometric shape of the bridge are explained.

Figure 1:
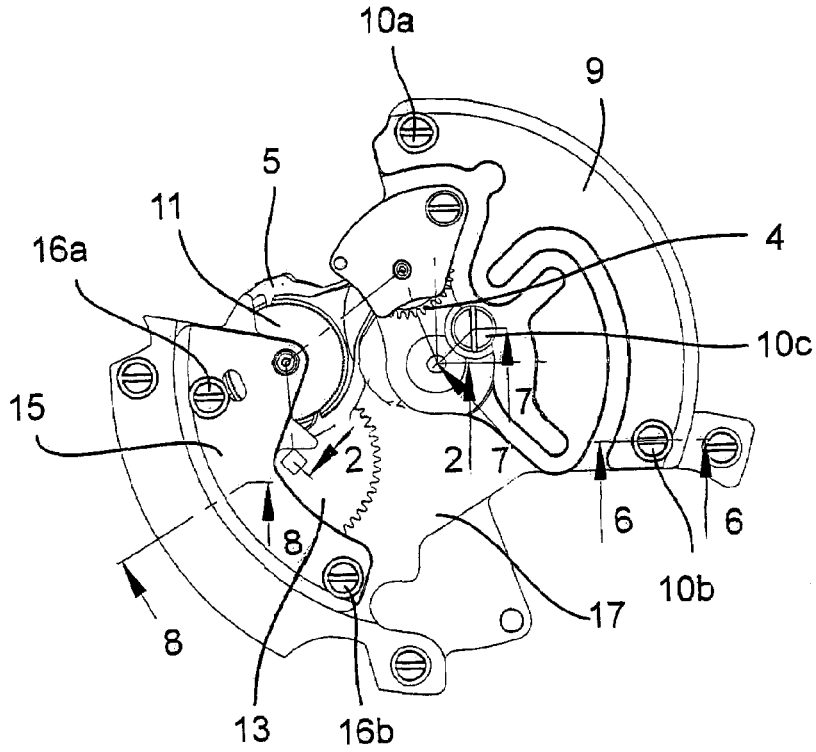
FIG. 1 is a plan view of the automatic pawl winding mechanism without the rotor, mounted on the barrel bridge in the example shown.
Figure 6:
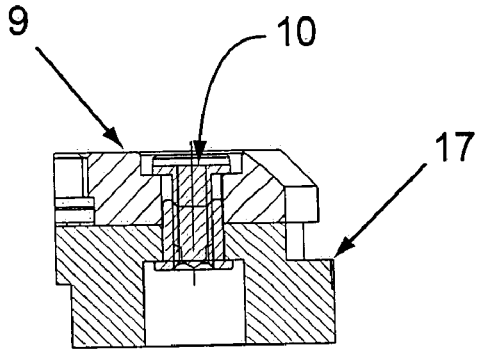

FIG. 6 is a section along line 6-6 of FIG. 1.

Figure 7:
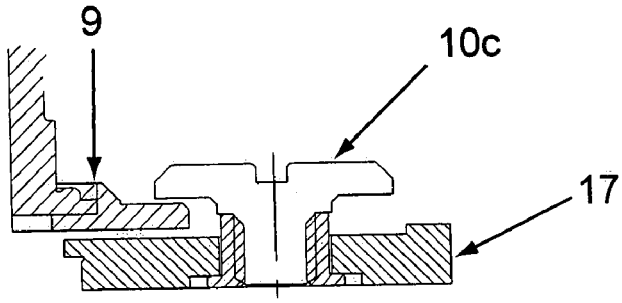

FIG. 7 is a section along line 7-7 of FIG. 1.

Figure 8:
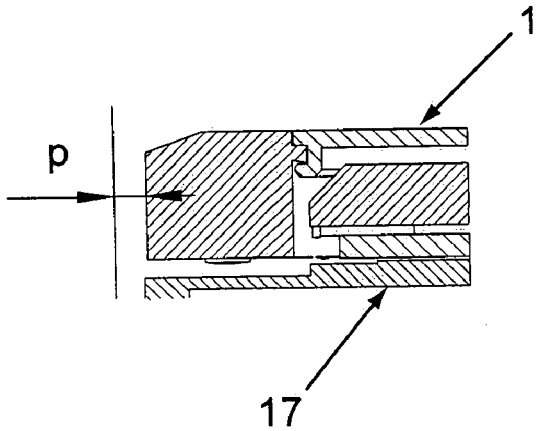

FIG. 8 is a section along line 8-8 of FIG. 1, with the rotor.

Figure 9A:
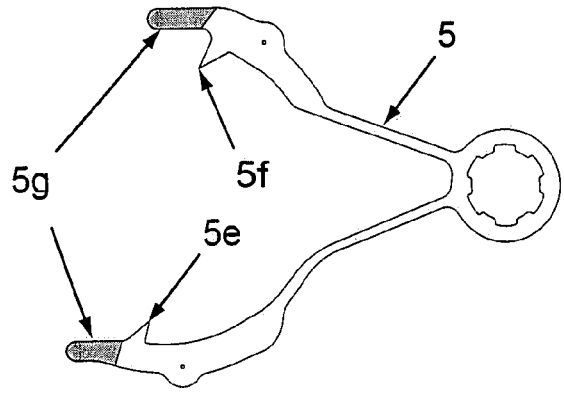
Figure 9B:
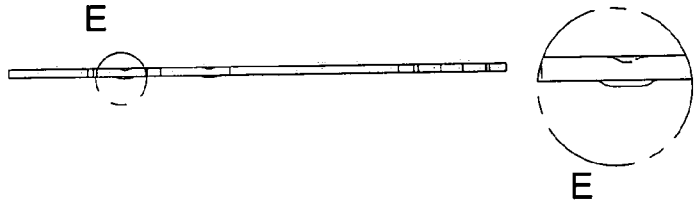

FIG. 9*a* is a plan view of a pawl, and FIG. 9*b* is a lateral view of such a pawl showing a segment of the pawl in detail.

Figure 10A:
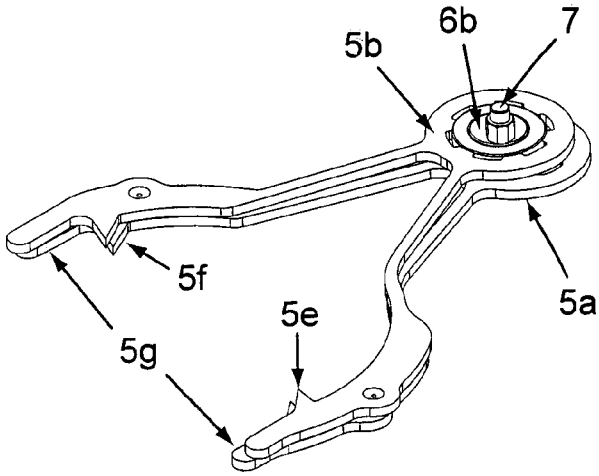
Figure 10B:
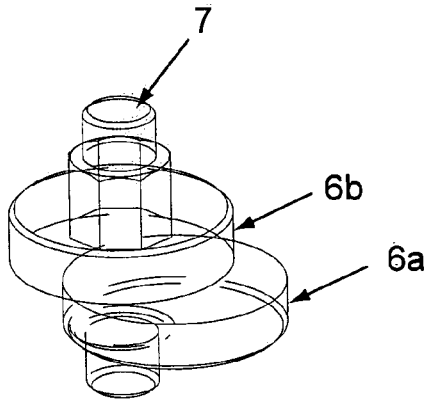

FIGS. 10*a* and 10*b* are perspective views of two pawls that are eccentrically superimposed and attached to a pawl wheel shaft, and of this pawl wheel shaft with its eccentrics.

The invention will now be described in detail while referring to the attached drawings illustrating by way of example an embodiment of the invention.

Figure 2:
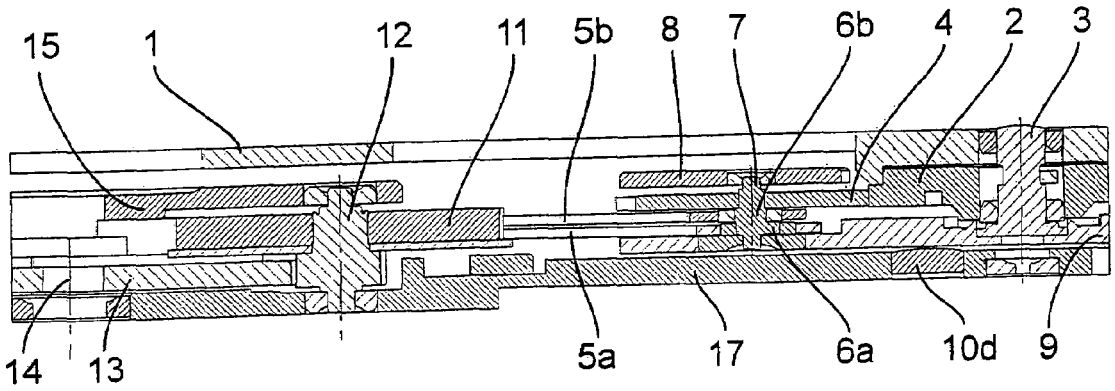
FIG. 2 is a section along line 2-2 of FIG. 1.

Referring to FIGS. 1 and 2 it should at first be pointed out that the automatic pawl winding mechanism according to the present invention is intended for easy integration into a watch movement. As in the ordinary case of such mechanisms, it comprises a rotor 1 solidly attached to a rotor wheel 2 oscillating about the geometric axis of a rotor pivot 3. A pawl wheel 4 is articulated rotatably about the geometric axis of a pawl wheel shaft 7. The oscillating motion of rotor 1 is transmitted to this pawl wheel 4, at least via the rotor wheel 2. The mechanism further comprises at least one, preferably two pawls 5*a*, 5*b* mounted eccentrically and in a pivoting manner about the axis of pawl wheel shaft 7, as well as an automatic wheel 11 cooperating with the pawl or pawls 5*a*, 5*b* in such a manner that the oscillating motion of rotor wheel 2 is transformed in known fashion into a unidirectional rotary motion of the automatic wheel 11 in the direction of winding of the movement. This rotary motion is then transmitted via a transformation gear train 12 to a ratchet wheel 13 in order to wind the movement. For the sake of simplicity, the automatic wheel 11 preferably is solidly connected with an automatic pinion 12 directly engaged with ratchet wheel 13 that is placed on a barrel shaft (not shown), such that the automatic pinion 12 represents the transformation gear train mentioned above. The gear ratio can be modified depending on the size of the torque required to wind the barrel, by adding one or several transmission wheels to that shown in FIG. 2 to explicitly constitute a gear designated as transformation gear train 12.

In the example represented in the drawings, the automatic pinion 12 is pivoted between a base bridge 17, here the barrel bridge, and an automatic bridge 15 attached to the base bridge with two screws 16*a* and 16*b*. The barrel shaft which is indicated in the figures with its geometric axis 14 is attached between the barrel bridge 17 and a base plate (not shown). The elements of the mechanism from the automatic wheel 11 to the automatic pinion 12 which can be seen in the left-hand part of FIG. 1 thus constitute a separate unit attached between base bridge 17 and automatic bridge 15.

For a more detailed description of the elements represented in the right-hand part of FIG. 1, it should first be remarked that the rotor 1 as well as the gear train from the rotor 1 with rotor wheel 2 to the pawl wheel 4 with the pawl or pawls 5*a*, 5*b* are mounted solely on an independent rotor bridge 9, without that the rotor or this gear train have any point of attachment to another support structure, and whilst no other element of the mechanism is mounted on this independent rotor bridge 9. Thus, bridge 9 and the elements 1 to 8 that are mounted on this bridge constitute an independent module of the mechanism.

Preferably, the oscillating motion of rotor 1 is transmitted directly from the rotor wheel 2 to the pawl wheel 4, the latter being directly engaged with the rotor wheel 2, rather than providing further intermediate wheels forming a more complicated gear train, which would be another possibility. In fact, it can be seen from FIG. 2 that rotor 1 is attached as an overhanging projection to the rotor pivot 3, which also holds the rotor wheel 2. As an alternative, the rotor pivot could be replaced by a ball bearing, for instance, inasmuch as only the oscillation of rotor 1 and rotor wheel 2 about their geometric axis is important. In the embodiment represented in the figures, pawl wheel 4 is attached to pawl wheel shaft 7 which in turn is rotatably attached between the independent rotor bridge 9 and a pawl wheel bridge 8. The latter is attached solely to the independent rotor bridge 9 and thus constitutes a part of bridge 9, hence does not detract from the independence of bridge 9 relative to the remaining mechanism. Again, since it is only the oscillation of pawl wheel 4 about its geometric axis which is important, it would be possible as well to mount the pawl wheel 4 as an overhanging projection on a pawl pivot attached to the independent rotor bridge 9, while for instance the eccentrics determining the movement of pawl(s) 5*a*, 5*b* would be attached to pawl wheel 4.

Pawl(s) 5*a*, 5*b* are mounted in the conventional way, that is, freely rotatable, each about an eccentric 6*a*, 6*b* which in the embodiment shown in the figures is placed on pawl wheel shaft 7. As indicated in the attached drawings, and notably in FIGS. 10*a* and 10*b*, the pawl wheel shaft 7 preferably has two pawls 5*a*, 5*b* while the axes of the corresponding eccentrics 6*a*, 6*b* are mutually offset in order to increase the efficiency of the mechanism, the pawls being arranged in such a manner that the first pawl 5*a* actuates the automatic wheel 11 while the second pawl 5*b* is at a dead angle where it has little or no effect on this wheel, and vice versa.

As to the operating principle of the mechanism, which corresponds to that of known devices, for instance as described in patent documents CH 284 841, DE 882 227, and CH 254 578 assigned to the International Watch Corporation (IWC), the section through the complete automatic mechanism including rotor 1 as shown in FIG. 2 nicely illustrates the cinematic chain from rotor 1 to the barrel. An oscillating motion of rotor 1 is first transmitted to pawl wheel 4 by rotor wheel 2. The motions of the pawls about the eccentrics 6*a*, 6*b* sitting on the axis of pawl wheel 4 give rise, either via the end 5*e* of one of the pawls 5 to a pull acting on the automatic wheel 11, or via the end 5*f* to a push acting on the automatic wheel 11, see FIG. 10*a*. Whatever the direction of rotation of rotor 1, the direction of rotation of the automatic wheel 11 will always be the same and match the direction of winding of the movement. The rotary motion of automatic wheel 11 is then transmitted to the ratchet wheel 13 and to the barrel shaft by automatic pinion 12.

In its preferred embodiment shown in the drawings, and notably in FIGS. 3 to 5*b*, the independent rotor bridge 9 is attached to the base bridge 17, solely with one of its ends 9*a*. The other end of bridge 9 is free, in this case, and comprises a segment 9*e* serving as a point of attachment for the rotor pivot 3 and pawl wheel shaft 7. A part of bridge 9 which connects end 9*a* with the free end 9*e* acts like a spring, in such a manner that the independent rotor bridge 9 constitutes a shock absorber for parts 1, 2, 3, 4, 5, 6, 7, 8 mounted on this bridge 9. The bridge thus comprises a flexible section and is attached in such a manner that it is partially capable of carrying out a movement, rather than being rigid and being rigidly mounted.

The independent rotor bridge 9 or, generally, a support according to the invention has a special geometric shape shown in detail in FIGS. 5*a* and 5*b* and includes a number of functional segments in order to obtain the elastic properties more particularly mentioned in the introduction and notably the same values of the spring constant in a given plane. Firstly, it comprises a first rigid segment 9*a* representing the end attached to the base bridge 17, here the barrel bridge, the attachment being realised for instance with the aid of two screws 10*a* and 10*b*, as illustrated in FIGS. 1 and 6. It then comprises a section acting as a spring and including a first elastic segment 9*b* attached to the first rigid segment 9*a* as well as a second elastic segment 9*d*, the two elastic segments 9*b* and 9*d* being inter-connected by a second rigid segment 9*c*. The bridge finally comprises a third rigid segment 9*e* attached to the second elastic segment 9*d*, and constituting the free end of the independent rotor bridge 9. At least the two elastic segments 9*b* and 9*d* lie in one plane and procure spring constants having the same value in all directions of this plane to the independent rotor bridge 9.

In addition, the orientations of the straight-line main segments of the neutral axes of the two elastic segments 9*b*, 9*d* of the independent rotor bridge 9 which are hatched in FIG. 5*a* subtend an angle of about 90°, such that spring constants having the same values in all directions of the plane mentioned above are achieved, a situation illustrated in FIG. 5*a*. This property is in fact necessary when the two elastic segments 9*b*, 9*d* have identical elastic properties. If this is not the case, then the orientations of these two segments 9*b*, 9*d* can be selected alternatively in such a manner that the differences in their elastic properties are compensated, such that bridge 9 as a whole still is provided with spring constants having the same values in all directions in its plane. By varying the width b as well as the length of the elastic arms, see FIG. 5*a*, it is possible to modify the constant of elasticity of an elastic segment or of the elastic section of the support.

In the preferred embodiment of an independent rotor bridge or support according to the present invention, the distances d1 and d2 between the geometric centres c1, c2 of the two elastic segments 9*b*, 9*d* of the independent rotor bridge 9 and the centre of rotation R of rotor 1 are close to $d1=d2=D/\sqrt{2}$. These values are indicated schematically in FIG. 5*b*, where D=b1+b2 is the sum of the distances b1 and b2 between the geometric centres c1, c2 of the two elastic segments 9*b*, 9*d* and a line perpendicular to these distances and passing through the centre of rotation of rotor 1.

Figure 4:
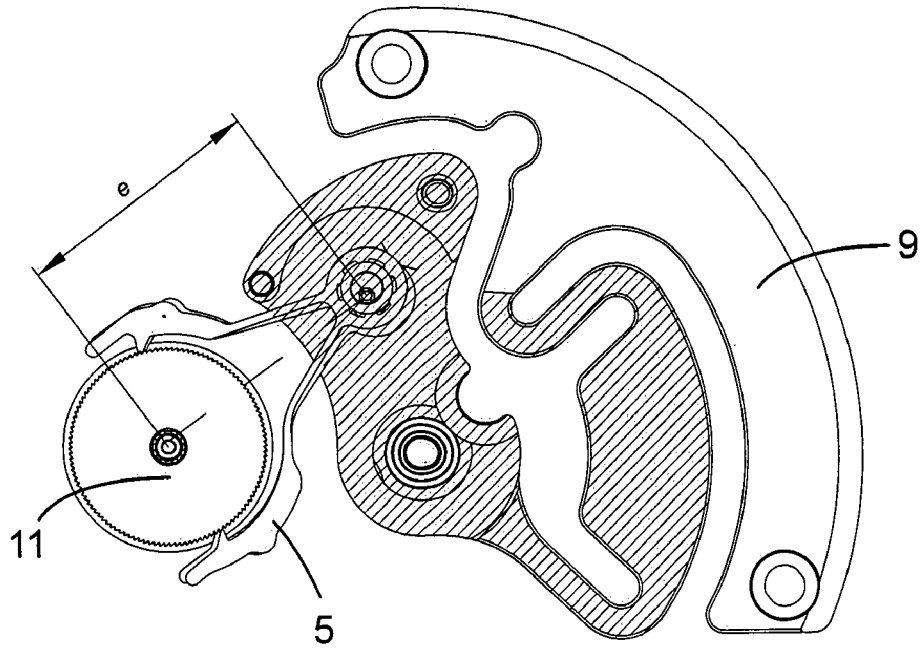
FIG. 4 is a plan view of FIG. 3 in which elements of the bridge that may shift under the effect of shocks are hatched.

Thus, independent rotor bridge 9 not only constitutes an independent module together with the elements 1 to 8 attached to it, but also acts as a shock absorber for these elements, and notably for rotor 1. The hatched region in FIG. 4 is the section that can move during shocks. The distance e between the axes can vary without detriment to the function of the automatic mechanism, since the connection between pawl wheel 4 and automatic wheel 11 is secured by pawls 5, and hence is not rigid.

The movement of the free end 9*e* of the independent rotor bridge 9 in a direction perpendicular to the plane of construction of bridge 9 can be limited by a height-limiting screw 10*c* as illustrated in FIGS. 1 and 7.

The movements of the free end 9*e* of the independent rotor bridge 9 can be limited in the directions within the plane of construction of bridge 9*e* by a rigid element of the watch case that lies in the same plane as the rotor 1, or by any other adequate means, in order not the exceed the admissible strain of the support material. In FIG. 8, the space p remaining between rotor 1 and the element of the case serving as a stop is indicated.

Advantageously, each free end of a pawl 5*a*, 5*b* has an extension forming a support and release finger 5*g*, see FIG. 9*a*. These extensions 5*g* have two main functions, as is evident from the name. Firstly, in the case of shocks in a direction perpendicular to the plane of bridge 9 the support and release finger 5*g* contacts the automatic bridge 15, thus avoiding that pawl 5 slides beyond the automatic wheel 15, which would put the mechanism out of operation. Second, with the aid of suitable tools it is possible to push these elements 5*g* apart simultaneously, and to release the pawls 5 from the automatic wheel 11. This is of interest during assembly when the mechanism must be disengaged.

Detail E in FIG. 9*b* shows a pressure point which is a raised point on each arm of pawl 5*b*, and which in the preferred case of using two pawls 5*a*, 5*b* allows to maintain a distance. This serves to reduce possible friction between pawls 5*a*, 5*b*. FIG. 10*a* is a perspective view showing the superposition of the two pawls 5*a*, 5*b* mounted on their axis, that is, on pawl wheel shaft 7.

After this detailed description, the advantages of the present invention will be clear.

Integrating the pawl wheel with its axis and the pawl (or pawls), the whole being held for instance by a pawl wheel bridge, into an independent rotor support is advantageous inasmuch as the mechanism thus forms a modular system comprising more particularly the rotor module sitting on the rotor bridge. On the other hand, the automatic wheel with its pinion sitting on the automatic bridge can be regarded as a further independent unit.

Considering the non-rigid connection between these two units that is provided by the pawls, this arrangement moreover will not detract from the functioning of the automatic mechanism.

Assembly of such a mechanism is rapid and simple, and requires no particular setting.

Using a flexible support in accordance with the present invention which acts as a shock absorber, values of the spring constant are provided for the support which are almost identical in all directions of motion of the support in its plane of construction, but at the same time a strong rigidity in a direction perpendicular to this plane is provided.

When used as a support for a rotor, this elastic property reduces the loads acting on the rotor pivot, and thus makes it possible to reduce the diameter of the pivot and thus the frictional losses.

It is further possible by this elastic property to noticeably reduce the transmission of vibrations produced by the rotary motions of the rotor. The characteristic frequency of a rotor is between 3 and 6 Hz and resembles the oscillating frequency of the regulating organ situated between 2.5 and 5 Hz. With a support rigidly attached to the basic movement, interfering effects may have a negative influence on the isochronism of this organ, while this situation can be improved by a support according to the present invention.

The combination of a flexible rotor support with an automatic pawl winding mechanism according to the present invention has further advantages.

A movement of the flexible section of the independent rotor bridge which occurs under the influence of shocks does not detract from the functions of the automatic mechanism. It is even likely that part of the shock energy is transmitted to the automatic winding mechanism, and adds to the energy provided by the rotor. In fact, a movement equal to the amplitude of the eccentric of the pawl wheel axis in the flexible region of the independent rotor bridge in the direction from the axis of the pawl wheel shaft to the axis of the automatic pivot corresponds to approximately half a turn of the rotor.

In any case, shocks are absorbed by the support and possibly by part of the casing or the height-limiting screw.

The spring constant of the support can be selected such that the deformation of the pawl is compensated when it is acting upon the automatic wheel. In fact, the pawl is deformed when the section of the pawl working in traction pulls a tooth of the automatic wheel, and the system's geometry is not optimal in case of rigid supports, thus an inferior efficiency is possible. The support proposed here, to the contrary, moves under the effect of the same force in the direction of the automatic wheel and compensates the pawl's deformation. The same compensating effect is present at the other segment of the pawl that works in compression.

It should be noted that for the combination of a flexible support with a pawl winding mechanism the particular number of pawls is irrelevant. The version involving two pawls has only been described here for reasons of the system's efficiency.

Lastly, the flexible support according to the invention is not necessarily the point of attachment for rotor and pawl wheel but may more generally be used in any application in watches requiring characteristics similar to the ones described above.

The invention claimed is:

1. Automatic pawl winding mechanism for watch movements having a rotor (1) solidly attached to a rotor wheel (2) and oscillating about the axis of a rotor pivot (3), a pawl wheel (4) to which an oscillating motion of the rotor (1) is transmitted being attached rotatably about the axis of a pawl wheel shaft (7), at least one pawl (5*a*, 5*b*) being attached eccentrically to the axis of the pawl wheel shaft (7), and an automatic wheel (11) cooperating with the pawl or pawls (5*a*, 5*b*) in such a manner that the oscillating motion of the rotor wheel (2) is transformed into a unidirectional rotary motion of the automatic wheel (11) and that this rotary motion is transmitted to a ratchet wheel (13) via a transformation gear train (12), characterised in that the rotor (1) together with the gear train from the rotor (1) with its rotor wheel (2) to the pawl wheel (4) with the pawl or pawls (5*a*, 5*b*) is mounted on an independent rotor bridge (9) while no other organ of the mechanism is mounted on this independent rotor bridge (9).

2. Automatic pawl winding mechanism according to claim 1, characterised in that the oscillating motion of the rotor (1) is transmitted from the rotor wheel (2) directly to the pawl wheel (4), the latter being engaged with the rotor wheel (2).

3. Automatic pawl winding mechanism according to claim 1, characterised in that each pawl is attached to an eccentric (6*a*, 6*b*) attached about the axis of the pawl wheel shaft (7).

4. Automatic pawl winding mechanism according to claim 3, characterised in that the axis of the pawl wheel shaft (7) includes two pawls (5*a*, 5*b*), the axes of the corresponding eccentrics (6*a*, 6*b*) being mutually offset.

5. Automatic pawl winding mechanism according to claim 1, characterised in that each end of a pawl (5*a*, 5*b*) has an extension forming a support and release finger (5*g*).

6. Automatic pawl winding mechanism according to claim 1, characterised in that the automatic wheel is solidly connected with an automatic pinion (12) engaged with the ratchet wheel (13) on a barrel shaft.

7. Automatic pawl winding mechanism according to claim 1, characterised in that the independent rotor bridge (9) is attached to a base bridge (17), solely with an end (9*a*) of the rotor bridge while another free end comprises a segment (9*e*) serving as points of attachment for the rotor pivot (3) and the pawl wheel shaft (7), while a section of the rotor bridge (9) between the fixed end (9*a*) and the free end (9*e*) is acting as a spring in such a manner that the independent rotor bridge (9) constitutes a shock absorber for parts (1, 2, 3, 4, 5, 6, 7, 8) mounted on the rotor bridge (9).

8. Automatic pawl winding mechanism according to claim 7, characterised in that the independent rotor bridge (9) comprises a first rigid segment comprising an end attached to the base bridge while the section acting as a spring comprises a first elastic segment (9*b*) solidly attached to the first rigid segment (9*a*) and a second elastic segment (9*d*), the two elastic segments (9*b*, 9*d*) being interconnected via a second rigid segment (9*c*), a third rigid segment (9*e*) being solidly attached to the second elastic segment (9*d*) and comprising the free end of the independent rotor bridge (9), wherein at least the two elastic segments (9*b*, 9*d*) lie in a plane and impart to the independent rotor bridge (9) a value of the spring constant that is the same in all directions in this plane.

9. Automatic pawl winding mechanism according to claim 8, characterised in that orientations of straight-line main segments of neutral axes of the two elastic segments (9*b*, 9*d*) of the independent rotor bridge (9) subtend an angle close to 90°.

10. Automatic pawl winding mechanism according to claim 8, characterised in that distances d1 and d2 between geometric centers (c1, c2) of the two elastic segments (9*b*, 9*d*) of the independent rotor bridge (9) and the center of rotation (R) of the rotor (1) are close to $d1=d2=D/\sqrt{2}$, where $D=b1+b2$ is the sum of the distances b1 and b2 between the geometric centers (c1, c2) of the two elastic segments (9*b*, 9*d*) and a line running perpendicular to these distances and through the center of rotation of rotor (1).

11. Automatic pawl winding mechanism according to claim 7, characterised in that motion of the free end (9*e*) of the independent rotor bridge (9) in a direction perpendicular to a plane of construction of the rotor bridge (9) is limited by a height-limiting screw (10*c*).

12. Automatic pawl winding mechanism according to claim 7, characterised in that motion of the free end (9*e*) of the independent rotor bridge (9) in directions lying in a plane of construction of the rotor bridge (9) is limited by a rigid element of a watch case situated in a same plane as the rotor (1).

13. Automatic pawl winding mechanism according to claim 7, characterised in that motion of the free end (9*e*) of the independent rotor bridge (9) in directions lying in a plane of construction of the rotor bridge (9) in the case of shocks is apt to give rise to a movement of the pawl or pawls (5*a*, 5*b*) which is transformed into a unidirectional rotary motion of the automatic wheel (11), such that energy of a shock is used at least in part for winding of the movement.

14. Movement, characterised in that it comprises an automatic pawl winding mechanism according to claim 1.

* * * * *